United States Patent [19]

Totten et al.

[11] Patent Number: 4,463,036

[45] Date of Patent: Jul. 31, 1984

[54] PROCESS FOR IMPARTING HYDROPHILICITY TO FABRIC

[75] Inventors: George E. Totten, West Haverstraw; Angelo J. Sabia, Yorktown, both of N.Y.

[73] Assignee: Union Carbide Corporation, Danbury, Conn.

[21] Appl. No.: 454,361

[22] Filed: Dec. 29, 1982

[51] Int. Cl.[3] ..... B05D 3/02

[52] U.S. Cl. ..... 427/389.9; 252/8.6; 252/8.9; 427/393.1; 427/393.4

[58] Field of Search ..... 427/389.9, 393.4, 393.1; 252/8.6, 8.9

[56] References Cited

U.S. PATENT DOCUMENTS 3,213,053 10/1965 Kendrick ..... 260/29.6

FOREIGN PATENT DOCUMENTS 1427787 6/1971 France .

513282 6/1971 Switzerland .

*Primary Examiner*—Thurman K. Page

*Attorney, Agent, or Firm*—Jean B. Mauro

[57] ABSTRACT

A process for imparting hydrophilicity to fabric which comprises treating the fabric with a composition comprising a copolymer of an N-(oxymethyl)-acrylamide grafted onto a poly(oxyalkylene) backbone and an acid catalyst to facilitate cross-linking of the graft copolymer on the fabric surface and drying said fabric at a temperature sufficient to cure the graft copolymer.

5 Claims, No Drawings

PROCESS FOR IMPARTING HYDROPHILICITY TO FABRIC

BRIEF SUMMARY OF THE INVENTION

1. Technical Field

The present invention relates to a process for imparting to fabric a durable hydrophilic finish by treatment with a crosslinkable graft copolymer of an N-(oxymethyl)-acrylamide and a poly(oxyalkylene).

2. Background Art

The unblended polyester fabrics produced for the garment industry are hydrophobic. This leads to two problems in the use of a polyester fabric. Hydrophobic fabrics are not easily treated in an aqueous medium unless a surfactant is added to aid in wetting the fabric. Even more importantly, garments made from a polyester fabric do not readily absorb perspiration from the skin of the wearer. This imparts a hot or clammy feel to the polyester garment which leads to consumer discomfort and in turn to consumer resistance of polyester fabrics. It would be advantageous to develop a durable hydrophilic finish for a polyester fabric. It is known in the art of fabric treatment that a crosslinkable copolymer can be applied to a fabric to affect the physical properties thereof. for example, U.S. Pat. No. 3,213,053 to Kendrick discloses that an antistatic composition of a crosslinkable terpolymer of: (1) 5% to 10% of glycidyl methacrylate; (2) 35% to 55% of an alkali metal salt of a styrene sulfonate; and (3) 35% to 60% of methoxypoly(ethylene glycol) methacrylate wherein the poly(ethylene glycol) chain has a molecular weight from 250 to 500, will reduce the static electricity of a synthetic fabric when applied as a finish. French Pat. No. 1,427,787 discloses that a copolymer of: (1) from 2% to 20% of an ethylenically unsaturated epoxide or a corresponding methylol compound; with (2) from 98% to 80% of an ester of an ethylenically unsaturated carboxylic acid and an alkylphenoxy polyethylene glycol, will reduce the static electricity of synthetic fabrics when applied to said fabrics as a fabric finish. Swiss Pat. No. 513,282 discloses that a copolymer composed of: (1) from 80% to 90% of an ester of an alkyl polyethylene glycol having an alkyl residue with 1 to 3 carbon atoms and an average molecular weight of from 300 to 1000 and an ethylenically unsaturated polymerizable carboxylic acid; (2) 5% to 10% of an etherified N-methylolamide of an ethylenically unsaturated polymerizable carboxylic acid; and (3) 5% to 10% of an ethylenically unsaturated polymerizable compound containing at least one acid group capable of imparting solubility in water, e.g. acrylic acid; will reduce the static electricity associated with a synthetic fiber and enhance the soil release properties of such a fabric.

SUMMARY OF THE INVENTION

In accordance with the present invention, it has been found that the process which comprises (a) treating a fabric with a neat composition, solution or dispersion containing:

(i) at least about 0.001% by solution weight or neat composition weight of an acid catalyst, and (ii) from about 0.1% to about 5% by solution weight or neat composition of a graft copolymer prepared by grafting to a poly(oxyalkylene) from about 0.5% to about 50% by graft copolymer weight of an N-(oxymethyl)-acrylamide having the formula:

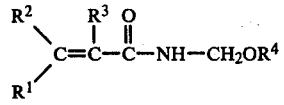

wherein $R^1$, $R^2$, $R^3$ and $R^4$ are hydrogen monovalent hydrocarbon radicals containing from 1 to 6 carbon atoms each and may be the same or different and a poly(oxyalkylene) of the formula:

$$R^5[(OC_2H_4)_x(OC_3H_6)_zOR^6]_a$$

wherein $R^5$ is a hydrocarbon radical having a valence of a and containing up to about 21 carbon atoms, a is an integer having a value between 1 and 4, $R^6$ is a hydrogen atom or hydrocarbon radical containing up to about 6 carbon atoms and x is an integer having a value from about 2 to about 5000, and z is an integer having a value from zero to about 5000; and (b) drying and curing said treated fabric imparts the property of hydrophilicity to the fabric manifested by a decrease in the time necessary to wet the fabric.

DETAILS OF THE INVENTION

The preparation of graft copolymers suitable for use in the present invention is described in co-pending application Ser. No. 307,211, filed Sept. 30, 1981.

They are prepared by a method which comprises adding a N-(oxymethyl) acrylamide as hereinafter more fully described and a suitable catalyst to an agitated bath of the poly(oxyalkylene), whereby all of said components are intimately admixed at a temperature at which reaction occurs, and maintaining said temperature until said graft copolymer of acrylamide derivative on poly(alkylene oxide) is obtained.

The grafting monomers employed in preparing the copolymers useful in the present invention are optionally substituted N-(oxymethyl)-acrylamide monomers having the formula:

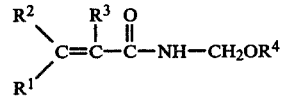

wherein $R^1$, $R^2$, $R^3$, and $R^4$ are a hydrogen atoms or a monovalent hydrocarbon radicals containing from 1 to about 6 carbon atoms. These acrylamide derivatives are generally homopolymerizable monomers with a reactive cross-linkable pendant group or groups. Illustrative suitable monomers are methoxymethyl acrylamide, ethoxymethyl acrylamide, N-butoxymethyl acrylamide, allyloxymethyl acrylamide, N-butoxymethacrylamide and preferably, N-methylolacrylamide and N-(isobutoxymethyl)-acrylamide.

The poly(oxyalkylene) compounds used to make the graft copolymers of the invention are known in the art and have the formula:

$$R^5[(OC_2H_4)_x(OC_3H_6)_zOR^6]_a$$

wherein $R^5$ is a hydrocarbon radical containing up to 20 carbon atoms and has a valence of a, a is an integer having a value of 1 to 4, $R^6$ is a hydrogen atom or a monovalent hydrocarbon radical containing up to 6 carbon atoms, x is an integer having a value of from 2 to about 5,000 and z has a value of from zero to about 5000.

In general, these compounds contain oxyethylene and oxypropylene groups, either in random or block distribution in their molecules, and have molecular weights (number average) in the range of about 100 to about 35,000, and, preferably, in the range of about 1,500 to about 4,000. These poly(oxyalkylene) compounds may be made by processes well known in the art by reacting an alkylene oxide or mixtures of alkylene oxides with an aliphatic compound which may be saturated or contain some aliphatic unsaturation, having from one up to as many as four active hydrogen atoms, such as water, monohydroxylic alcohols such as ethanol, propanol, and allyl alcohol; dihydroxylic alcohols such as ethylene glycol and monoethylether of glycerine; trihydroxylic alcohols such as glycerine and trimethylolpropane; and tetrahydroxylic alcohols such as sorbitol. The poly(oxyalkylene) products of such reactions will have linear or branched oxyalkylene or mixed oxyalkylene chains, and such chains will terminate with hydroxyl groups. Some or all of these hydroxyl groups may be etherified by reaction with a dialkyl sulfate such as diethyl sulfate or an alkyl halide such as ethyl chloride.

A grafting catalyst is employed which is a free radical initiator. The choice of such initiator is not critical as any one of a wide variety of known inorganic or organic initiators of free radical polymerization may be used. The choice of initiator will generally depend on the particular combination of reactants from which the graft copolymer will be prepared. For example, if a given grafting monomer will self-condense at the grafting reaction temperature necessary for a given catalyst, then the reaction mixture will form an undesireable gel; i.e. the graft copolymer will cure before application to the fiber. Therefore, a catalyst must be chosen such that the grafting reaction temperature will not cause the grafting monomer self-condense. Exemplary of suitable initiators are azobis[isobutyronitrile]; hydroxyperoxides such as t-butyl hydroperoxide and cumene hydroperoxide; acyl peroxides such as benzoxyl peroxide; peroxides such as t-butyl peroxypivalate, di-t-butyl peroxide, and t-butyl perbenzoate; peroxycarbonates such as diethyl peroxydicarbonate and diisopropyl peroxycarbonate; and persulfates such as potassium and sodium persulfates.

Homogeneous graft copolymers of the present invention which are substantially free (contains less than 2 percent by weight) of insoluble homopolymerized acrylamide derivative may be prepared by methods known in the art but preferably are prepared by charging the reactants in two separate feed streams, in gradual and/or incremental amounts, one of which contains the grafting monomer and a second which contains the free radical grafting initiator. Either of the reactants may be mixed with a portion of the poly(oxyalkylene) compound prior to feeding them to the reaction medium when doing so facilitates the gradual or incremental feeding thereof to the reaction mixture. The amount of acrylamide derivative added to the polymerization reactor is not critical and may be varied over a wide range. In general, however, up to about 70 percent by weight, and preferably from about 1 percent by weight to about 50 percent by weight based on the total weight of poly(alkylene oxide) compound, is charged.

The temperatures at which the graft reaction, of the present invention may be carried out may vary over a wide range and depend, in general, upon the combination of reactants to be used in the reaction and the catalyst chosen to catalyze the graft reaction. However, reaction temperatures above 160° C. generally lead to gelling of the reaction mixture and should be avoided. For example, when organic free radical grafting initiators are employed, a temperature sufficient to activate the initiator up to about 160° C. can be used in the grafting reaction, and preferably, a temperature in the range from about 70° C. to about 100° C. Where employing inorganic free radical initiators, a temperature from about the freezing point of the solvent to about 65° C. should be employed.

Incremental and/or gradual addition of the two separate reactant feed streams coupled with efficient agitation of the poly(oxyalkylene) compound in the reactor constitutes the most important technique for producing the graft copolymers useful in the present invention. This method is particularly important in large scale or commercial operations, not only for preparing the desired homogenous graft copolymer, but also to facilitate handling and storage of the monomer and the free radical initiator.

The grafting reaction is preferably carried out in bulk without the use of a solvent. If desired, however, a solvent may be used which is inert to the reactants. Suitable solvents include benzene, toluene, tertiary-butylbenzene, heptane, hexane, octane, and mixtures thereof, and water.

The graft copolymer is then mixed with an acid catalyst and applied to the fabric to be treated.

The process of the instant invention is exemplified hereinafter by the application of the graft copolymer to 100% polyester fabrics made from polyethylene terephthalate. Examples of suitable polyester fabrics are Kodel, a registered trademark of Eastman Kodak and Dacron, a registered trademark of E. I. duPont de Nemours. However, it is to be understood that the process of the instant invention is not limited to polyester fabrics. It is believed that substantial hydrophilicity would be imparted to other textile fabrics, e.g. nylon, synthetic/natural fiber blends, etc.

In the most preferred embodiment the graft copolymers are made from a poly(oxyethylene-co-oxypropylene) of molecular weight in the range of 350 g/mol to 4000 g/mol to which has been grafted N-methylolacrylamide (NMA) or N-(isobutoxymethyl)-acrylamide (IMBA) in a ratio such that at least an average of 1½ N-(oxymethyl)-acrylamide molecules are grafted onto each poly(oxyalkylene) molecule and most preferably from 3 to 6 N-(oxymethyl)acrylamide molecules per poly(oxyalkylene) molecule.

The choice of acid catalyst suitable for use in the invention is not critical and may depend on economic or toxicological factors. Any acid that will lower the pH sufficiently to make the solution weakly acidic will catalyze the cross-linking of the graft copolymer on the fabric surface. Examples of acid catalysts include inorganic acids such as hydrochloric, hydrobromic, sulfuric and nitric acids; organic acids such as carboxylic acids, phenols, alkyl and aryl sulfonic acids and the like. Lewis acids such as zinc fluoroborate and the like will also catalyze the graft copolymer cross-linking on the surface of the fabric. In the most preferred embodiment, the acid catalyst chosen is water soluble because an aqueous solution is a convenient medium with which to apply the graft copolymer to the fabric.

The graft copolymer and acid catalyst may be applied as a neat composition or a solution. Any solvent which will dissolve the graft copolymer may be used. Suitable solvents include water, alcohols, ketones, esters or mixtures thereof that will dissolve the graft copolymer and the acid catalyst. When water is used as the solvent, a functional additive such as an anionic or nonionic surfactant may be added to facilitate the initial wetting of the fabric. In the most preferred embodiment, the graft copolymer and acid catalyst are added to water to form a treatment solution that is from about ½% to about 15% by solution weight of graft copolymer and about 0.1% to about 2% by solution weight of the acid catalyst.

The solution or composition may be applied by contacting the fabric with it in any manner that is effective to wet the fabric. Assuming a solution is used, if the fabric is deposited in a bath containing the treatment solution, the residence time in the bath need only be so long as to allow the fabric to be substantially wetted by the solution. The addition of wetting agents such as surfactants will reduce the necessary residence time. Other functional additives such as colorants, sizing agents, etc. may also be added to the treating bath along with a surfactant. The temperature of the treatment solution is not critical so long as it is maintained below the temperature that will cross-link the graft copolymer in solution with the acid catalyst. The treated fabric is then exposed to a temperature and for a period of time sufficient to dry the fabric and cure the graft copolymer on the fabric surface. Generally, a few minutes in an oven at between 100° C. and 170° C. is sufficient, to cure the graft copolymer and remove any excess solvent taken up by the fabric in treatment.

The dried, treated fabric is then ready for further processing with the graft copolymer cross-linked on the surface of the fabric as a durable, hydrophilic fabric finish. Any residual acid catalyst may be removed by further processing which may include a simple rinsing procedure.

This invention is further described in the Examples which follow. These examples are intended to be illustrative of specific embodiments of this invention and are not intended in any way to limit the invention. All parts and percentages are by weight unless otherwise specified.

EXAMPLES 1 AND 2

Graft Copolymer Preparation

Example 1

A four-neck round-bottom glass flask, fitted with a mechanical stirrer, thermometer, water condenser with nitrogen source, two 250-inch dropping funnels and nitrogen outlet, was charged with 184.3 gm of an allyl-started ethylene oxide/propylene oxide copolymer (40/60 by weight) having a viscosity of 450 SUS (Seconds, Universal Saybolt). One dropping funnel was charged with 64.3 gms of N-(isobutoxymethyl)-acrylamide (IMBA) and the other was charged with 20.3 gms of ethyl acetate and 1.3 gms of 2,2-azobis(2-methylpropionitrile). The flask contents were heaed to 80° C. with an electrical heating mantle and the flask was purged with dry nitrogen. The IMBA and ethylacetate/2,2-azobis(2-methylpropionitrile) were added simultaneously and dropwise over a period of one hour at a rate which kept the reaction mixture between 80° and 83° C. After addition of the IBMA and ethyl acetate/2,2-azobis(2-methylpropionitrile) was completed, the flask and its contents were heated to 80° C. for three additional hours and then allowed to cool to room temperature. Any remaining unreacted IBMA was removed by vacuum stripping along with the ethyl acetate used to introduce the acid catalyst. The graft copolymer obtained thereby was a clear, pourable liquid that could be added to water to make the fabric treating solution or applied to the fabric as a neat composition with the acid catalyst.

Example 2

A 250 ml three neck round-bottom flask equipped with a stirrer was used in this example. To this reactor was charged 120 grams of distilled water, 0.5 gram of sodium bicarbonate, 0.5 gram of sodium sulfite and 0.5 gram of sodium persulfate. After dissolution of the salts was completed by stirring, 15.3 grams (0.0059 mole) of the poly(oxyalkylene) polymer used in Example 2 were added and the resulting solution was cooled to 0° to 5° C. A 48 percent aqueous solution of N-methylolacrylamide containing 7.4 grams (0.034 mole) (28.6 weight percent of the total charge) with 5.0 grams additional water was added dropwise to the reaction mixture over a period of 15 minutes. After addition of all reactants was completed, the reaction mixture was stirred for an additional 45 minutes while maintaining the temperature at 0° to 5° C., and then the reaction mixture was allowed to warm to room temperature.

This crude reaction mixture may then be diluted to form a treating solution upon the addition of water and a suitable acid catalyst.

EXAMPLES 3–14

The 100% polyester fabric samples tested in the following examples, 3–14, were treated by immersing them in a bath containing a solution of 5% graft copolymers by weight along with 0.1% paratoluene sulfonic acid as a catalyst and 0.1% Tergitol TMN-6, a non-ionic surfactant available from Union Carbide Corporation, to aid wetting in treatment. The fabric was weighed before immersion, immersed, retrieved and then pressed in a Mathis two-bowl Vertical Laboratory Padder, type VF, with a pad pressure of 1 bar and a roller speed of 6 rpm. The resulting weight of the wet, treated fabric indicated a wet pickup of treating solution of 60% to 70% by weight of the fabric. These wet samples were then placed upon a frame and dried in a Mathis Laboratory Drying and Curing Apparatus, type LTF, for 2 minutes at 165° C. The curing of the graft copolymer occurred during this drying cycle.

The samples were then conditioned and tested for wettability in accordance with AATCC Test Method 39-1977 promulgated by the American Association of Textile Chemists and Colorists for the Evaluation of wettability of fabric. The readings therefrom are expressed in the average time in seconds needed to visibly wet the tested fabric with a drop of water. The shorter the average wetting time, the more hydrophilic is the fabric. The samples were then laundered in accordace with AATCC Test Method 130-1977 the number of times indicated in Table I.

The AATCC Standard Detergent 124 was used in an amount of about 140 grams in a #4 wash load with a washing temperature of about 120° F. and a rinse temperature of about 105° F. The laundered samples were then reconditioned in accordance with AATCC Test Method 39-1977 for re-testing.

The data contained in Table I sets forth the nature of the graft copolymer applied to the fabric, the initial wettability of the samples and the wettability after five standard launderings.

TABLE I

| Example | Ethylene/ Propylene Oxide Ratio (weight %) | Approximate Molecular Wt. (g/mol) | Amount of IBMA (weight percent) | Amount of NMA | $R^5$ | $R^6$ | Wettability (Sec) Initial | Wettability (Sec) After 5 Launderings |
|---|---|---|---|---|---|---|---|---|
| 3 | (control) | — | — | — | — | — | >300 | >300 |
| 4 | 1/0 | 790 | — | 28.6 | allyl | methyl | 21 | 44 |
| 5 | .75/.25 | 4000 | — | 18.8 | hydrogen | hydrogen | 88 | 54 |
| 6 | .4/.6 | 1400 | 25.9 | — | allyl | methyl | 4 | 7 |
| 7 | .4/.6 | 2600 | 15.7 | — | allyl | methyl | 3 | 7 |
| 8 | .4/.6 | 3600 | 11.9 | — | allyl | methyl | 3 | 10 |
| 9 | .4/.6 | 1400 | 14.0 | — | allyl | methyl | 3 | 10 |
| 10 | .75/.25 | 1400 | 20.0 | — | allyl | methyl | 3 | 4 |
| 11 | .75/.25 | 1400 | 25.9 | — | allyl | methyl | 3 | 4 |
| 12 | .4/.6 | 1400 | 25.9 | — | allyl | hydrogen | 3 | 3 |
| 13 | .75/.25 | 4000 | 20.0 | — | hydrogen | hydrogen | 4 | 13 |
| 14 | .75/.25 | 4000 | 6.5 | — | hydrogen | hydrogen | 4 | 20 |

The data shows that significant durable hydrophilicity is obtained with N-methylol-acrylamide graft copolymers and that superior durable hydrophilicity is obtained with N-(isobutoxymethyl)-acrylamide graft polymers. The data also shows that the structure and functionality of the graft copolymer is not critical within the claimed ranges of structure and functionality of the polyether precursor.

EXAMPLES 15–19

The data in Table II sets forth the nature of the graft copolymers applied to the 100% polyester fabric tested in examples 15–19 along with the wettability results after 5, 10, 15 and 20 standard launderings. The treatment process of examples 15–19 is otherwise identical to the treatment process described for examples 3–14.

TABLE II

| Example | Ethylene/ Propylene Oxide Ratio | Approximate Molecular Wt. (g/mol) | Amount of IBMA (by weight %) | Amount of NMA | $R^5$ | $R^6$ | Wettability After Laundering (Sec) 5X | 10X | 15X | 20X |
|---|---|---|---|---|---|---|---|---|---|---|
| 15 | 1/0 | 350 | 41.8 | — | allyl | hydrogen | 22 | 40 | 22 | 27 |
| 16 | 1/0 | 360 | 55.5 | — | allyl | methyl | 22 | 28 | 15 | 32 |
| 17 | .4/.6 | 1400 | 14.5 | — | allyl | hydrogen | 12 | 32 | 38 | — |
| 18 | .4/.6 | 1400 | 20.5 | — | allyl | hydrogen | 4 | 10 | 10 | 26 |
| 19 | .4/.6 | 1400 | 41.0 | — | allyl | hydrogen | 9 | 15 | 16 | 17 |

The data in Table II shows that extended durability of hydrophilicity is achieved for the N-(isobutoxymethyl)-acrylamide graft copolymer of the present invention regardless of the structure or functionality of the graft copolymer within those shown in Table II.

EXAMPLES 20–22

The data in Table III sets forth the effect of a catalyst on the cross-linking of the graft copolymer on the surface of the treated fabric. The graft copolymer is the same as that described in Example 18 and the treatment process was identical with the exception of the varied catalyst type and concentration.

TABLE III

| Example | Catalyst | Concentration (wt. %) | Wettability (sec) After 5 Launderings |
|---|---|---|---|
| 20 | None | — | >300 |
| 21 | para-toluene sulfonic acid | .2% | 4 |
| 22 | zinc fluoroborate | 1.4% | 11 |

The data in Table III illustrates the need for a Lewis acid catalyst, but that the choice of catalyst is not critical.

EXAMPLES 23–25

The data in Table IV illustrates the effect of solution concentration of the graft copolymer of Example 18 in the treatment bath. The other treatment process conditions were identical to those of examples 3–18.

TABLE IV

| Example | IBMA Graft Copolymer Concentration (wt %) | Wettability after Launderings (sec) 5X | 10X | 15X |
|---|---|---|---|---|
| 23 | — | >300 | >300 | >300 |
| 24 | 1 | 25 | 45 | 48 |
| 25 | 5 | 2 | 18 | 22 |

The data shows that although increasing hydrophilicity is imparted by increased solution concentrations, as little as 1% graft copolymer in solution imparts substantial hydrophilicity to the fabric tested.

We claim:

1. A process to impart durable hydrophilicity to fabric which comprises:

(a) treating a polyester fabric with a neat composition, solution or dispersion containing:

(i) at least about 0.001% by solution weight or neat composition weight of an acid catalyst selected from the group consisting of p-toluene sulfonic acid and zinc fluoroborate, and (ii) from about 0.1% to about 5% by solution weight or neat composition weight of a graft copolymer prepared by grafting to a poly(oxyalkylene) from about 0.5% to about 50% by graft copolymer weight of an N-(oxymethyl)-acrylamide having the formula:

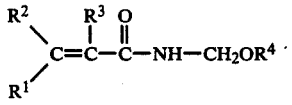

wherein $R^1$, $R^2$, $R^3$ and $R^4$ are hydrogen or monovalent hydrocarbon radicals containing from 1 to 6 carbon atoms each and may be the same or different to a poly(oxyalkylene) of the formula:

$$R^5[(OC_2H_4)_x(OC_3H_6)_zOR^6]_a$$

wherein $R^5$ is a hydrocarbon radical having a valence of a and containing up to about 21 carbon atoms, a is an integer having a value between 1 and 4, $R^6$ is a hydrogen atom or hydrocarbon radical containing up to about 6 carbon atoms and x is an integer having a value from about 2 to about 5000, and z is an integer having a value from about zero to about 5000;

(b) drying said treated textile fabric at a temperature between about 100° C. and about 170° C. to produce a fabric having a wettability of no more than 40 seconds after 20 launderings in accordance with AATCC Test Methods 39-1977 and 130-1977, respectively.

2. The process of claim 1 wherein said optionally substituted N-oxymethyl derivative of acrylamide is N-methylol-acrylamide.

3. The process of claim 1 wherein said optionally substituted N-(oxymethyl) derivative of acrylamide is N-(isobutoxymethyl) acrylamide.

4. The process of claim 1 wherein said poly(oxyalkylene) is made by reacting an alkylene oxide, or mixtures thereof, with an aliphatic unsaturation and which contains from one to four active hydrogen atoms.

5. The process of claim 1 wherein the poly(oxyalkylene) is poly(oxyethylene), poly(oxypropylene) or mixtures or copolymers thereof.

* * * * *

UNITED STATES PATENT AND TRADEMARK OFFICE

CERTIFICATE OF CORRECTION

PATENT NO. : 4,463,036

DATED : July 31, 1984

INVENTOR(S) : George E. Totten, Angelo J. Sabia

It is certified that error appears in the above—identified patent and that said Letters Patent is hereby corrected as shown below:

Claim 4, line 3, after "aliphatic" insert --compound which is saturated or contains aliphatic--.

Signed and Sealed this

First Day of January 1985

[SEAL]

*Attest:*

GERALD J. MOSSINGHOFF

*Attesting Officer*

*Commissioner of Patents and Trademarks*